United States Patent [19]

Sieler

[11] Patent Number: 4,703,813

[45] Date of Patent: Nov. 3, 1987

[54] CEMENTING PORTION OF CONDUCTOR STRING

[75] Inventor: Jeffrey J. Sieler, Kenner, La.

[73] Assignee: Shell Offshore Inc., Houston, Tex.

[21] Appl. No.: 846,646

[22] Filed: Mar. 31, 1986

[51] Int. Cl.[4] ..... E21B 7/12; E21B 19/09; E21B 34/13

[52] U.S. Cl. ..... 175/5; 166/285; 166/359

[58] Field of Search ..... 166/285, 287, 289, 358; 175/5

[56] References Cited

U.S. PATENT DOCUMENTS

| | | | |
|---|---|---|---|
| 2,852,078 | 9/1950 | Krause, Jr. | 166/285 X |
| 4,095,437 | 6/1978 | Lox | 166/351 X |
| 4,201,074 | 5/1980 | Lox | 166/356 X |
| 4,334,582 | 6/1982 | Baker et al. | 166/289 X |

*Primary Examiner*—George A. Suchfield

[57] ABSTRACT

An apparatus and method useful in offshore well drilling operations for cleaning the annular space between mudline suspension risers during and after cementing operations to assure that riser backout may be accomplished if a temporary abandonment of a well is to take place. A two-section drive pipe having a quick stab connector between the upper and lower sections of the pipe is provided with ports around the periphery of the lower section and above the mudline. Circulation of fluid down high pressure hoses connected to these ports and up the annulus between the drive pipe and well conductor string within the drive pipe is established using rig pumps located on the deck of the rig. Simultaneously, cement slurry is pumped down the well conductor string to the bottom of the well and up the annulus between the drive pipe and well conductor string. Once either returns of diluted cement slurry discharged from the annulus are observed at the deck of the rig or a predetermined quantity of cement slurry has been pumped down the well conductor string, the pumping of cement slurry is stopped. Circulation of the liquid down the high pressure hoses and up the annulus is continued until substantially all cement which would foul-up the disconnection of well equipment above the ocean floor has been washed out of the annulus.

10 Claims, 4 Drawing Figures

FIG. 1
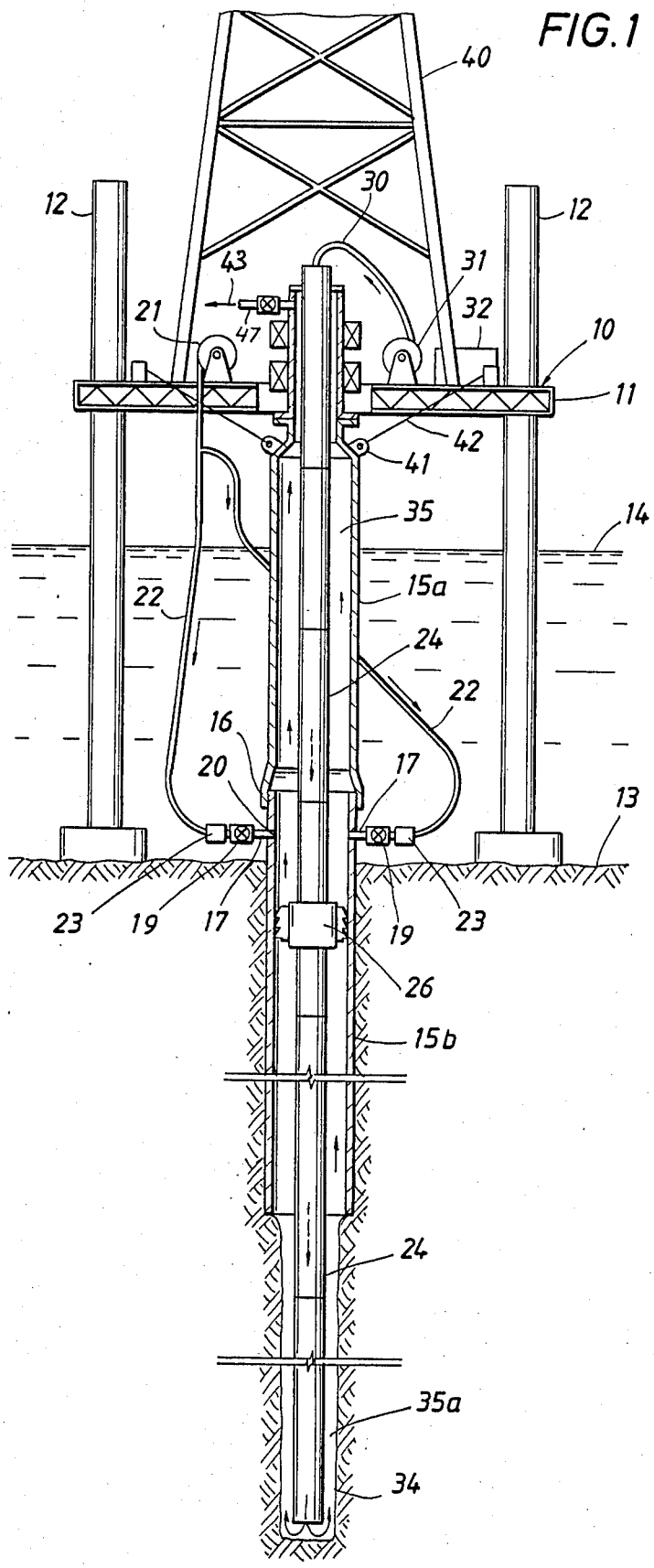
FIG. 2
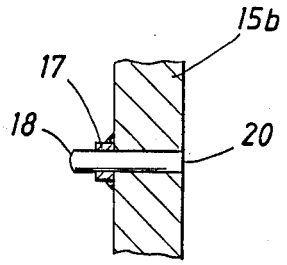
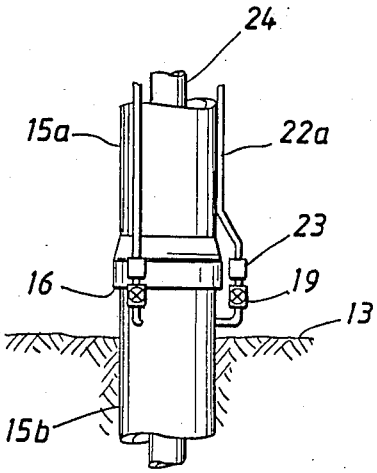
FIG. 3
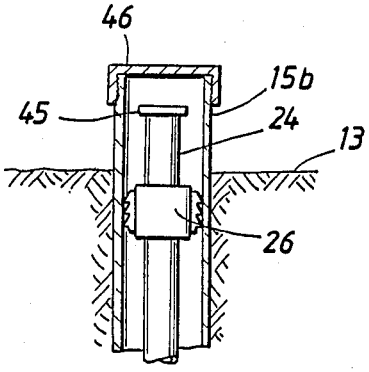
FIG. 4

CEMENTING PORTION OF CONDUCTOR STRING

BACKGROUND OF THE INVENTION

This invention relates to a method and apparatus useful in offshore well drilling operations for cleaning the annular space between mud line suspension risers during and after cementing operations to assure that riser backout may be accomplished if a temporary abandonment of a well is to take place.

Federal regulations concerning cementing of the annular space between the well conductor string and drive pipe of an offshore well require that either cement slurry returns be observed at the surface of the platform or that a predetermined quantity of cement slurry sufficient to fill the annular space of the well conductor string and drive pipe near the disconnection of well equipment above the ocean floor be used. However, cement slurry contained in the annular space will typically foul-up the disconnection of well equipment above the ocean floor, such as a drive-pipe connector, so as to prevent backing out the riser if the well must be temporarily abandoned.

It is the object of the present invention to provide a method and apparatus for cleaning the annular space above the ocean floor mud line between mud line suspension during and after cementing operations so as to prevent cement slurry from setting up in normally disconnectable pipe joints, couplings or pipe connectors.

SUMMARY OF THE INVENTION

The present invention is directed to a method and apparatus for drilling an offshore well from a movable drilling rig and cementing at least a portion of a well conductor string in the well. A large diameter two-section drive pipe, having a quick stab connector between the upper and lower sections of the drive pipe, is lowered from the deck of the rig and into the ocean floor to start a well drilling operation. The lower section of the drive pipe is provided with ports spaced around the periphery of the drive pipe and above the mudline. A threaded nipple is welded over each port and a plug is installed in each nipple.

Before cementing a well conductor in the well within the drive pipe, divers remove the plugs and install valves and connectors in the lower section of the drive pipe. A high pressure hose is then connected to the connectors at the end of each installed valve. Circulation of fluid is established down the high pressure hoses and up the annulus between the drive pipe and the well conductor string using rig pumps located on the deck of the rig. The annular space between the well conductor string and the drive pipe below the ocean floor is then cemented by pumping cement slurry down through the well conductor string to the bottom of the well and up the annulus between the drive pipe and the well conductor string. Simultaneously, liquid is pumped down the high-pressure hoses and into the lower section of the drive pipe above the ocean floor to commingle and dilute the cement slurry stream flowing upwardly in the annulus. Once either returns of diluted cement slurry discharged from the annulus are observed at the deck of the rig or a predetermined quantity of cement slurry has been pumped down the well conductor string, the pumping of cement slurry is stopped. Circulation of the liquid down the high pressure hoses and up the annulus is continued until no further return of cement in the liquid is observed and substantially all cement which would foul-up the disconnection of well equipment above the ocean floor has been washed out of the annulus. Retarded seawater is then spotted in the annular space and divers remove the valves and install plugs in the nipples of the lower section of the drive pipe above the mud line.

An advantage of the present invention is that the annulus between the well conductor string and drive pipe can be cleaned to assure riser backout in the event that a temporary abandonment of the well becomes necessary while complying with the above-mentioned federal regulations.

The various features of novelty which characterize the invention are pointed out with particularity in the claims forming a part of this disclosure. For a better understanding of the invention, its operating advantages and specific object obtained by its uses, reference may be made to the accompanying drawings and descriptive matter in which there are illustrated preferred embodiments of the invention.

BRIEF DESCRIPTION OF THE DRAWINGS

FIG. 1 is a diagrammatic view of an offshore well installation including a jack-up rig from which a well has been drilled into the ocean floor.

FIG. 2 is a cross-sectional view of a threaded nipple and plug installed in a port of a lower section of a drive-pipe.

FIG. 3 is a diagrammatic view of a pipe connection arrangement to the lower section of the drive pipe above the mudline.

FIG. 4 is a cross-sectional schematic view of a temporarily abandoned well.

DESCRIPTION OF THE PREFERRED EMBODIMENT

Referring to FIG. 1 of the drawing, a jack-up rig, of the type used to drill, work-over, or maintain offshore oil and gas wells and represented herein by numeral 10, may comprise a plurality of legs 12 extending upwardly from the seabed or ocean floor 13 to a suitable level, say 50 feet, above the water surface 14 where a deck 11 is positioned. The deck 11 of the rig 10 carries a derrick 40 and suitable equipment for drilling wells.

The offshore well installation shown in FIG. 1 includes a large diameter drive pipe having upper **15*a* and lower 15*b* portions connected and extending downwardly from the rig 10 into the ocean floor 13. The releasable connector means 16 connecting the upper 15*a* and lower 15*b* sections of the drive pipe is preferably located above but close to the mudline of the ocean floor 13. The lower section of the drive pipe 15*b* is provided with fluid inlet means 20, such as ports, through the wall of the drive pipe just above the ocean floor 13 and below the connector 16, as illustrated in FIG. 1. The ports, preferably three in number, are equally spaced around the periphery of the lower section 15*b* of the drive pipe. Each of these ports 20 is provided with threaded nipples 17 into which a temporary plug 18 (FIG. 2) is installed prior to the installation of the drive pipe 15*a* and 15*b***.

Conduit means, such as flexible high pressure hoses 22, which may be installed by divers at a later time, are provided to extend from liquid pump means, such as a water pump 21, on the rig 10 to be in communication with the interior of the drive pipe **15*b*** through the ports 20 of the lower section 15*b* of the drive pipe. Other or second releasable connector means, such as a connector 23 for the flexible hose 22 are located at the end of each hose and adjacent to the ports 20 in the lower section 15*b* of the drive pipe. The connector 23 for each hose preferably comprises two portions, the first portion being adapted to stab axially within the other portion to form the connection. Each hose 22 may also include a valve 19 between the releasable connector 23 for the flexible hose 22 and the port 20 in the lower section 15*b* of the drive pipe.

After carrying out well drilling operations from the rig 10 in a normal manner, by which a well borehole 34 is drilled to a selected depth, say 1000 feet, into the ocean floor 13, a well conductor string 24 is installed substantially concentrically in the borehole 34 through the drive pipe 15*a* and 15*b* forming an annulus 35 between the well conductor string 24 and the drive pipe 15*a* and 15*b* from the bottom thereof upwardly to the rig 10, and an annulus 35*a* between the well conductor 24 and the wall of the borehole 34. A lateral support or positioning means, such as the pad eye 41 and cable 42 arrangement shown in FIG. 1, between the upper section of the drive pipe 15*a* and the rig 10 may be employed to maintain the drive pipe 15*a* and 15*b* in a substantially vertical position.

Hanger means, such as the hanger 26 diagrammatically shown in FIG. 1, is mounted on the well conductor string 24 at a position below the ocean floor 13 so as to engage the lower portion 15*b* of the drive pipe.

FIG. 3 illustrates an alternate arrangement of the conduit means whereby the high pressure hoses are replaced by steel pipes 22*a* welded to the upper section 15*a* of the drive pipe so that a diver is not needed to connect the conduit means to the lower section 15*b* of the drive pipe. In this instance, the valves 19 would be power-actuated and remotely operable from the rig 10 so that a diver would not be required to manually open them.

Prior to cementing the well conductor 24 in the borehole 34 by placing cement slurry in the annulus 35*a* between the conductor and the borehole wall and in the annulus 35 between the drive pipe 15*a* and 15*b* and the well conductor string 24, divers remove the plugs 18 (FIG. 2) and install valves 19 (FIG. 1) with a threaded connection. Hose connectors 23 are also installed. High pressure water hoses 22 are then connected to the connectors 23 adjacent the installed valves 19. Circulation of liquid is established from a flush-water pump 21 down the hoses 22 and up the annulus 35 between the drive pipe 15*a* and 15*b* and the well conductor string 24. A retarding agent can be added to the liquid to slow down the setting of the cement slurry, if desired, at this time or near the end of the cementing operation.

Simultaneously, while maintaining circulation of the liquid through hoses 22, the well conductor string 24 is cemented in the well below the ocean floor 13. Cement slurry is pumped down through a cement hose or pipe 30 connected to a cement pump 31 fed by a cement hopper 32 down through the well conductor string 24 and up the annuli 35*a* and 35 between the drive pipe 15*a* and 15*b* and the well conductor string 24. Alternatively, the cement slurry may be pumped down through a cementing pipe string (not shown) positioned with the well conductor string 24 and up the annulus 35*a* and 35 between the drive pipe 15*a* and 15*b* and the well conductor string 24. As the cement slurry flows upwardly past the circulating inlet ports 17, it is diluted by one or more incoming streams of water from the hoses 22.

Once returns 43 of diluted cement slurry discharged from the annulus 35 are observed at the return line 47 on the deck 11 of the rig 10 or a predetermined quantity of cement slurry has been pumped down the well conductor string, pumping the cement slurry is stopped. However, circulation of liquid down the high pressure hoses 22 and up the annulus 35 is continued until no further return of cement in the liquid is observed and substantially all cement which would have fouled-up the disconnection of well equipment above the ocean floor has been washed out of the annulus. At this time all cement slurry will have been flushed from any part of connector 16 where it may have lodged.

After all cement has been flushed from the annulus 35, circulation of liquid down the hoses 22 is discontinued and divers are sent down to remove the hoses 22. However, if the hoses 22 are replaced by steel pipes 22*a*, as shown in FIG. 3, then divers need not be used because the connectors 16 and 23 can be remotely disconnected from the platform. The drive pipe section 15*a* and pipes 22*a* can be pulled up to the platform.

The well may be then temporarily abandoned by removing those portions of the well conductor string 24 and drive pipe 15*a* above the mudline of the ocean floor 13 and providing a cap 45 and 46 or plug for each, as shown in FIG. 4, in a manner well known to the art. A dome (not shown) can also be installed over the wellhead, if desired. It is to be understood that all other strings of pipe or casing within the conductor string 24 would have been unscrewed and withdrawn from below the mud line before the conductor string 24 is removed.

Thus, it can be seen that the above-mentioned objective may be accomplished, based on the description of the preferred embodiment, by practicing the above-described method.

What is claimed is:

1. The method of drilling an offshore well from a movable drilling rig and cementing at least a portion of a well conductor pipe string in the well, the method comprising:

lowering from said rig and into the ocean floor a large-diameter two-section drive pipe having a first releasable connector means between the upper and lower sections that are connected together just above the ocean floor;

providing fluid inlet means through the wall of said lower drive pipe section just below said connector means and just above said ocean floor;

providing high pressure fluid conduit means in communication with said fluid inlet means and having second releasable connector means adjacent thereto, said conduit means extending upwardly to the platform;

driving the lower section of said drive pipe into the ocean floor a distance such that the connector means and the fluid inlet means are above the ocean floor;

drilling the upper portion of the well at a selected diameter and to a selected depth through the drive pipe;

installing a well conductor in the drilled hole whereby an annulus is formed between the conductor and the drive pipe;

cementing the well conductor in the well below the ocean floor by pumping cement slurry down through the well conductor, out the bottom end thereof, and up the annulus between the drive pipe and the conductor;

simultaneously pumping liquid down said conduit means to said inlet means below said connector means and injecting said liquid into the cement slurry stream flowing upwardly in said annulus to dilute said cement slurry as it passes said inlet means;

stopping the pumping of cement slurry down the well conductor when the annulus has been filled up to at least the ocean floor to form a cement plug in the annulus;

preventing the formation of a cement plug in said annulus above said inlet means by continuing the injection of liquid through the inlet means and into the annulus to be discharged from the annulus at the rig; and stopping the pumping of liquid and its circulation up the annulus when substantially all the cement has been washed therefrom above the ocean floor.

2. An offshore well installation including a movable drilling rig from which a well has been drilled into the ocean floor comprising:

a large diameter drive pipe having upper and lower portions connected together just above the ocean floor and extending downwardly from the rig into the ocean floor, fluid inlet means through the wall of said drive pipe just above the ocean floor, first releasable connector means connecting the upper and lower sections of said drive pipe together just above the ocean floor and above said fluid inlet means, liquid pump means positioned on said rig;

conduit means in communication between the interior of said drive pipe through said fluid inlet means and said liquid pump means on said rig, said conduit means includes valve means between said second releasable connector means and said fluid inlet means;

second releasable connector means at the end of said conduit means and adjacent to said fluid inlet means; and a well conductor installed substantially concentrically in said drive pipe forming an annulus between said conductor and said drive pipe from the bottom thereof upwardly to said rig.

3. The apparatus of claim 2 wherein said installation includes positioning means between said drive pipe and said rig for maintaining said drive pipe in a substantially vertical position.

4. The apparatus of claim 2 wherein said second releasable connector means comprises two portions, the first portion being adapted to stab axially within the other portion to form the connection.

5. The apparatus of claim 2 wherein said fluid inlet means comprises a plurality of inlet means equally spaced around the periphery of said drive pipe.

6. The method according to claim 1 wherein said step of pumping liquid down said conduit means includes the step of adding retarding agent to said liquid to slow down the setting of the cement slurry.

7. The method of claim 1 wherein the liquid that is pumped down the high pressure conduit means is injected into the lower section of drive pipe at a plurality of points around the periphery of the drive pipe.

8. The method according to claim 1 wherein said cementing step includes the step of pumping cement slurry down through a cementing pipe string positioned within said conductor and up the annulus between said drive pipe and said conductor.

9. The method of drilling an offshore well from a movable drilling rig and cementing at least a portion of a well conductor pipe string in the well, the method comprising:

lowering from said rig and into the ocean floor a two-section drive pipe having a releasable connector between the upper and lower sections that are connected together just above the ocean floor;

drilling the well through the drive pipe;

installing a well conductor in the drilled hole thereby forming an annulus between the conductor and the drive pipe;

cementing the well conductor in the well below the ocean floor by pumping cement slurry down through the well conductor, out the bottom end thereof, and up the annulus between the drive pipe and the conductor;

simultaneously establishing circulation of liquid down conduits to a fluid inlet located below said connector but above the ocean floor and up the annulus between the drive pipe and well conductor thereby diluting the cement slurry flowinig upwardly in said annulus as it passes said inlet means;

stopping the pumping of cement slurry down the well conductor when the annulus has been filled up to at least the ocean floor to form a cement plug in the annulus; and preventing the formation of a cement plug in said annulus above said inlet means by continuing circulation of liquid until substantially all of the cement slurry which would foul-up disconnection of well equipment above the ocean floor has been removed.

10. The method of claims 1 or 9 including the step of abandoning said well.

* * * * *